US007762318B2

(12) United States Patent
Yu et al.

(10) Patent No.: US 7,762,318 B2
(45) Date of Patent: Jul. 27, 2010

(54) CONDENSING HEAT-EXCHANGE COPPER TUBE FOR AN FLOODED TYPE ELECTRICAL REFRIGERATION UNIT

(75) Inventors: Chuanfu Yu, Xinxiang (CN); Qiang Jiang, Xinxiang (CN); Jianjun Yan, Xinxiang (CN); Shouqing Chang, Xinxiang (CN)

(73) Assignee: Golden Dragon Precise Copper Tube Group, Inc., Xinxiang (CN)

( * ) Notice: Subject to any disclaimer, the term of this patent is extended or adjusted under 35 U.S.C. 154(b) by 145 days.

(21) Appl. No.: 11/637,622

(22) Filed: Dec. 12, 2006

(65) Prior Publication Data

US 2007/0131396 A1 Jun. 14, 2007

(30) Foreign Application Priority Data

Dec. 13, 2005 (CN) ..... 2005 1 0134632

(51) Int. Cl.
*F28F 1/14* (2006.01)
*F28F 13/12* (2006.01)

(52) U.S. Cl. ..... 165/133; 165/184

(58) Field of Classification Search ..... 165/133, 165/179, 183, 184, 109.1
See application file for complete search history.

(56) References Cited

U.S. PATENT DOCUMENTS 2,463,997 A * 3/1949 Rodgers ..... 72/370.18
3,326,283 A * 6/1967 Ware ..... 165/181
4,031,602 A * 6/1977 Cunningham et al. .. 29/890.036
4,044,797 A * 8/1977 Fujie et al. ..... 138/38
4,313,248 A 2/1982 Fujikake
4,549,606 A * 10/1985 Sato et al. ..... 165/179
5,186,252 A * 2/1993 Nishizawa et al. ..... 165/181
5,203,404 A * 4/1993 Chiang et al. ..... 165/133
5,333,682 A * 8/1994 Liu et al. ..... 165/133

(Continued)

FOREIGN PATENT DOCUMENTS

CN 2226744 Y 5/1996

(Continued)

*Primary Examiner*—Tho v Duong
(74) *Attorney, Agent, or Firm*—Schwabe, Williamson & Wyatt

(57) ABSTRACT

The present invention discloses a condensing heat-exchange copper tube for a flooded type electrical refrigeration unit, which comprises a smooth surface portion, a finned portion provided with plurality of fins and a transitional portion connecting the smooth surface portion to the finned portion. Said fin includes a fin base close to the outer surface of the heat-exchange tube and a fin top away from the outer surface. Said fin is further provided with a secondary fin at the central portion of the fin and a third fin at the top portion of the fin, wherein a certain distance is provided between two axially adjacent secondary fins or two axially adjacent third fins. Secondary fins as well as third fins according to the invention further increase the heat transfer area for the heat-exchange tube. Meanwhile, secondary fins and third fins help to attenuate the condensate film such that the condensate film is substantially eliminated, and vapor condensation and heat transfer may be carried out in a better way. At the same time, secondary fins and third fins help to guide the condensate film away from the surface of the heat-exchange tube such that heat resistance may be reduced. Thus, the overall efficiency of heat transfer through condensation is enhanced, and the property of the condenser is improved.

8 Claims, 2 Drawing Sheets

U.S. PATENT DOCUMENTS 5,669,441 A * 9/1997 Spencer ..... 165/184
5,692,560 A * 12/1997 Messant et al. ..... 165/151
5,697,430 A 12/1997 Thors et al.
5,775,411 A 7/1998 Schuez et al.
6,488,078 B2 * 12/2002 Beutler et al. ..... 165/133
2007/0034361 A1 2/2007 Lu et al.

FOREIGN PATENT DOCUMENTS

CN 2527069 Y 12/2002
CN 1546933 11/2004

* cited by examiner

CONDENSING HEAT-EXCHANGE COPPER TUBE FOR AN FLOODED TYPE ELECTRICAL REFRIGERATION UNIT

RELATED APPLICATIONS

The present application claims priority to Chinese Patent Application No. 200510134632.8, entitled "A Condensing Heat-Exchange Copper Tube for a Flooded Type Electrical Refrigeration Unit", filed on Dec. 13, 2005.

TECHNICAL FIELD

The present invention relates to a condensing heat-exchange tube, especially to a condensing heat-exchange copper tube for a flooded type electrical refrigeration unit.

BACKGROUND

In recent years, the development of the manufacturing technology for a refrigerator or an air conditioner has been advanced due to a rapid development in the refrigeration technique and air-conditioning technique. Most effort is concentrated on providing a refrigerator or air conditioner with higher efficiency, less volume and lower weight, as well as an improved refrigerant. Meanwhile, the design and technical application for a heat-exchange tube used in the refrigerator or air conditioner has also been continuously improved. However, current heat-exchange tubes are all problematic in that a condensate film which functions as a thermal resistance develops when the refrigerant tries to condense, which thermal resistance adversely affects the heat transfer thus degrades the refrigeration efficiency. A most commonly used solution is to incorporate fins on the heat-exchange tube or directly form fins on the heat-exchange tube. However, heat resistance develops between the interface of the incorporated fins and the heat-exchange tube, which degrades the heat transfer efficiency of the heat-exchange tube. On other hand, fins directly formed on the heat-exchange tube are usually of small height, and it is difficult to achieve a relatively large heat transfer area on the heat-exchange tube. To increase the heat transfer area, one method is to stamp down a large portion of the fin so as to form a boss extending outwardly from the fin. However, heat transfer area for a heat-exchange tube so developed has not been increased markedly, since the only difference is that a portion of the original lateral surface is converted into a top surface perpendicular to the fin. Meanwhile, the boss is ineffective to attenuate or eliminate the condensate film, neither is it beneficial for a breaking off of the condensate film from the surface of the heat-exchange tube. Therefore, this boss configuration may not substantially improve or enhance the heat transfer property of the condensing heat-exchange tube and the condenser.

SUMMARY OF THE INVENTION

An object of the present invention is to provide a heat-exchange tube with higher efficiency.

A technical solution is developed to achieve said object. A condensing heat-exchange copper tube for a flooded type electrical refrigeration unit according to the present invention comprises a smooth surface portion, a finned portion provided with plurality of fins and a transitional portion connecting the smooth surface portion to the finned portion, with a fin base close to the outer surface of the heat-exchange tube and a fin top away from the outer surface provided on a fin. Said fin is further provided with a secondary fin, wherein a certain distance is provided between two axially adjacent secondary fins, and the distance between the secondary fin and the top surface of the fin is between ⅓ and ⅔ of the overall height of the fin.

Preferably, the fin is further provided with a third fin developed by stamping the fin radially downwardly from the top surface of the fin, wherein a certain distance is provided between two axially adjacent third fins.

Preferably, the third fin is arranged above the secondary fin along the same radial line.

Preferably, the third fin and the secondary fin are staggeredly arranged along the axial direction.

Preferably, the cross-section of the third fin defines a right triangle perpendicular to the fin, wherein a third groove is defined between the top surface of the third fin and the fin top, with the depth of the third groove between 0.15 and 0.45 mm, and the width of the third fin between 0.15 and 0.35 mm.

Preferably, the cross-section of the secondary fin defines a right triangle perpendicular to the fin, wherein a distance between the upper surface of the secondary fin and the top surface of the fin is between 0.3 and 0.7 mm, and the width of the secondary fin is between 0.15 and 0.35 mm.

Preferably, the width of the secondary fin is equal to the distance between two neighboring edges of two axially adjacent secondary fins 32.

Preferably, inner teeth are provided on the inner surface of the heat-exchange tube, wherein the inner tooth defines a substantially triangular section, with both the top and the root of the tooth rounded.

Preferably, the height of the inner tooth is between 0.2 and 0.4 mm, the addendum angle thereof is between 30° and 60°, and the pitch angle for the inner tooth is between 30° and 60 °.

Preferably, characterized in that: fins are arranged through a single spiral configuration, with a pitch angle between 0.3° and 1.5°.

The present invention is advantageous over prior art in that the condensing heat-exchange tube according to the present invention provides a larger heat transfer coefficient for the inner surface as well as the outer surface of the heat-exchange tube. Therefore, the heat transfer efficiency within the tube and outside the tube is enhanced, and the overall heat transfer efficiency is improved. The explanation is as follows. Secondary fins as well as third fins are provided on the fins arranged on the outer surface of the condensing heat-exchange tube according to the invention. Beside the fins, secondary fins and third fins further increase the heat transfer area for the heat-exchange tube. Meanwhile, secondary fins and third fins help to attenuate the condensate film such that the condensate film is substantially eliminated, and vapor condensation and heat discharge may be carried out in a better way. At the same time, secondary fins and third fins help to guide the condensate film away from the surface of the heat-exchange tube such that heat resistance may be reduced and temperature difference may be kept. Thus, the overall efficiency of heat transfer through condensation is enhanced, and the property of the condenser is improved. Inner teeth arranged on the inner surface of the tube are provided with substantially triangular configuration, and appropriate numbers of inner teeth are provided. Therefore, the heat transfer area for the inner surface of the heat-exchange tube is increased, and secondary turbulence is further developed in the cooling agent within the tube. Thus, the heat transfer efficiency within the tube is also enhanced.

| Numerals | |
|---|---|
| 100: | heat-exchange tube |
| 1: | smooth surface portion |
| 3: | finned portion |
| 31: | fin |
| 311: | base of the fin |
| 312: | top of the fin |
| 32: | secondary fin |
| 33: | third fin |
| 331: | third groove |
| 35: | inner tooth |
| 5: | transitional portion |
| D: | outer diameter of the smooth surface portion |
| T: | wall thickness for the smooth surface portion |
| Df: | outer diameter of the finned portion |
| Tf: | wall thickness of the finned portion |
| H1: | height of the fin |
| L1: | width of the fin |
| β 1: | outer pitch angle |
| FPI: | number of fins |
| Cd: | depth of the secondary groove |
| L2: | width of the secondary fin |
| H2: | stamp height of the secondary fin |
| H3: | depth of the third groove |
| L3: | width of the third fin |
| Rh: | height of the inner tooth |
| β 2: | pitch angle for the inner tooth |
| γ: | addendum angle for the inner tooth |

DETAILED DESCRIPTION OF THE ILLUSTRATIVE EMBODIMENTS

Preferred embodiments of the present invention will be described in more detail with reference to accompanying drawings. The present invention relates to a condensing heat-exchange copper tube 100 for a flooded type electrical unit, which is developed based on a research on the heat transfer mechanism for a flooded heat-exchange tube, molding device and molding process thereof, and which has a size between 12 and 26 mm, is adapted to be used in electrical cooling condenser so as to achieve a higher heat transfer efficiency.

Figure 1:
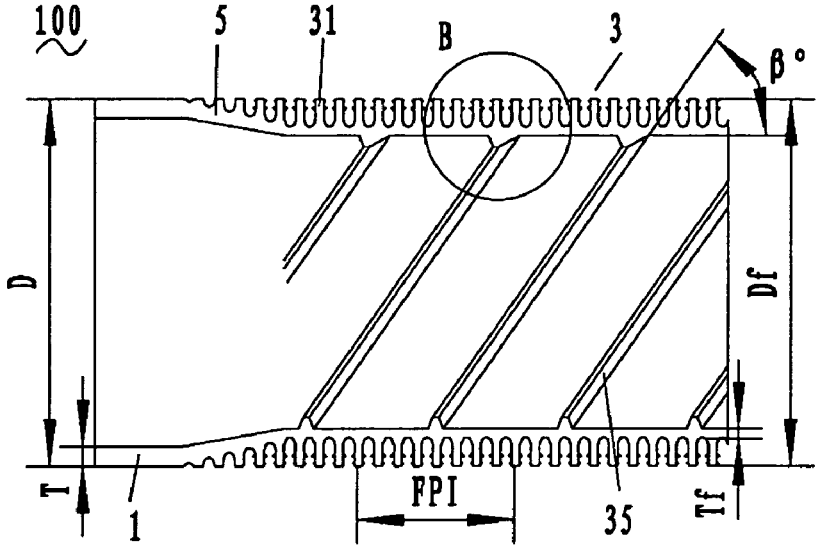
FIG. 1 is a sectional view of a condensing heat-exchange tube according to the present invention.
Figure 2:
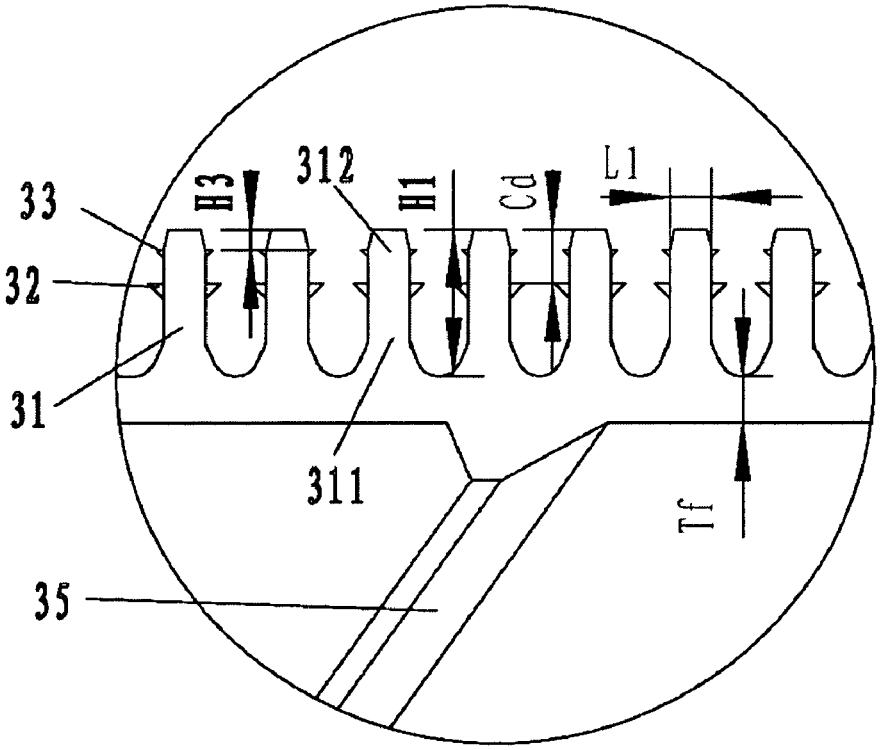
FIG. 2 is an enlarged view of the portion B in FIG. 1.

Referring to FIGS. 1 and 2, a condensing heat-exchange tube 100 according to the present invention, comprising a smooth surface portion 1, a finned portion 3 and a transitional portion connecting the smooth surface portion 1 to the finned portion 3, is manufactured by a threaded inner print and three sets of fin blades milling on the tube wall. The smooth surface portion 1 is formed by a raw tube without any processing. The diameter D of the smooth surface portion 1 is between 12 and 26 mm, the wall thickness T thereof is between 0.5 and 0.9 mm. Fins 31 in the transitional portion 5 is incomplete. Preferably, the condensing heat-exchange tube 100 according to the present invention is made of copper material.

Fins 31 are provided on the outer surface of the finned portion 3. Fins 31 are continuously arranged on the outer surface of the condensing heat-exchange tube 100 through a single spiral configuration, with an outer pitch angle β1 between 0.3° and 1.5°. The fin 31 comprises a fin base 311 and a fin top 312. A cross-section of the fin base 311 defines a rectangular, with a smooth transaction with the outer surface of the tube. A cross-section of the fin top 312 defines a trapezoid with a shorter top edge and a longer bottom edge, preferably an isosceles trapezoid. The wall thickness Tf of the finned portion 3 is between 0.5 and 0.9 mm. The height H1 of the fin 31 is between 0.7 and 1.2 mm, the width L1 thereof is between 0.15 and 0.35 mm, and the number of fins FPI per inch is between 30 and 70. These fins 31 advantageously result in an increase of the heat transfer area for the condensing heat-exchange tube, a decrease in the height of the condensate film, and a change in the surface tension. Therefore, the condensate film gets thinner, the heat resistance decreases, and the heat transfer coefficient of the heat-exchange tube 100 increases.

Figure 3:
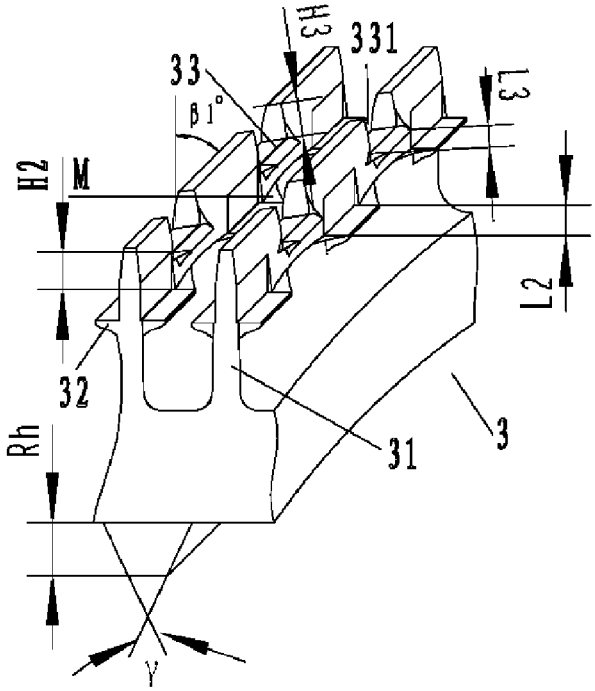
FIG. 3 illustrates a partial perspective view of a first embodiment of a condensing heat-exchange tube according to the present invention.

Referring to FIG. 3, a secondary fin 32 is provided substantially at the half height of a fin 31 extending outwardly along a radial direction. The secondary fin 32 is developed by stamping the fin 31 radially downwardly with a tool from a position below the fin top 311. Two adjacent secondary fins 32 along the axial direction of the heat-exchange tube 100 are separated apart with a certain distance. The stamp height H2 of the secondary fin 32 is between 0.15 and 0.4 mm. The cross-section of the secondary fin 32 defines a right triangle, with the longer leg thereof perpendicular to the fin 31. The depth Cd of the secondary groove of the secondary fin 32, that is to say the distance between the top surface of the fin 31 and the top surface of the secondary fin 32, is ⅓ to ½ of the height H1 of the fin 31. Preferably, the depth Cd of the secondary groove is between 0.3 and 0.7 mm, while the width L2 of the secondary groove is between 0.15 and 0.35 mm.

A fin 31 is further provided with a third fin 33. The third fin 33 is developed by stamping the fin 31 radially downwardly with a tool from the top surface of the fin 31. The third fin 33 is interposed between two adjacent secondary fins 32 along the axial direction of the heat-exchange tube 100, that is to say secondary fins 32 and third fins 33 are arranged in stagger manner, that is to say secondary fins 32 and third fins 33 are not provided on the same radial line. A third groove 331 is defined between the top surface of the third fins 33 and two adjacent fins 31. The height H3 for a third groove 331 is between 0.15 and 0.45 mm, while the width L3 for the third fin is between 0.15 and 0.35 mm. A third fin 33 is provided with a similar configuration with that of a secondary fin 32, i.e. a right triangle, with the longer leg perpendicular to the fin 31.

Inner teeth 35 are also provided on the inner surface of the condensing heat-exchange tube 100. Said inner tooth 35 has a substantially triangular cross-section, with both the top and the bottom of the tooth rounded. The inner teeth 35 are spirally arranged on the inner surface of the heat-exchange tube 100. The number of the inner teeth per inch is between 30 and 60, the height Rh of the inner tooth is between 0.2 and 0.4 mm, the pitch angle β for the inner tooth 35 is between 30° and 60°, and the addendum angle γ for the inner tooth 35 is between 30° and 60°.

Fins 31, secondary fins 32 and third fins 33 of a condensing heat-exchange tube 100 according to the present invention increase the heat transfer area for the heat-exchange tube 100, and the top structure of secondary fins 32 and third fins 33 facilitates attenuating or eliminating the condensate film such that vapor may be condensed more easily, as well as guiding the condensate film to flow away from the surface of the heat-exchange tube 100 such that heat resistance may be reduced and temperature difference may be kept. Therefore, vapor condensation and heat transfer may be carried out in a better way. Thus, the efficiency of heat transfer through condensation is enhanced, and the property of the condenser is improved. The inner tooth 35 is provided with a substantially triangular cross-section. Therefore, the heat transfer area for the inner surface of the condensing heat-exchange tube 100 is increased, and secondary turbulence is developed in the cooling medium within the condensing heat-exchange tube 100. Thus, the heat transfer efficiency within the tube is also enhanced.

Figure 4:
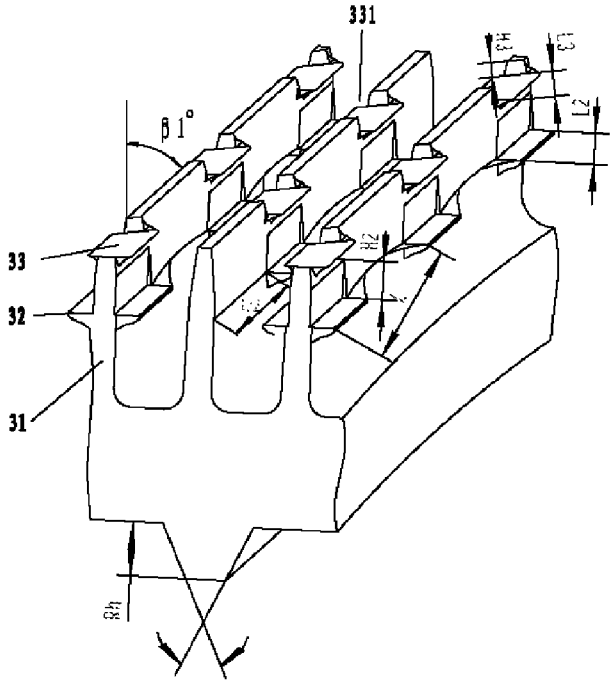
FIG. 4 illustrates a partial perspective view of a second embodiment of a condensing heat-exchange tube according to the present invention.

Referring to the second embodiment of this invention shown in FIG. 4. The condensing heat-exchange tube 100 of this embodiment differs from the embodiment shown in FIG. 3 only in that secondary fins 32 and third fins 33 are arranged in different manner. According to this embodiment, after secondary fins 32 are spaced formed along the fins 31, a fin top 312 above a secondary fin 32 is stamped radially downwardly to form a third fin 33. Therefore, the third fin 33 is located right above the secondary fin 32 in radial direction, that is to say third fins 33 and secondary fins 32 are arranged in rows, i.e., arranged on the same radial line. Similarly, the stamp height H2 of the secondary fin 32 is between 0.15 and 0.4 mm. The cross-section of the secondary fin 32 defines a right triangle, with the longer leg thereof perpendicular to the fin 31. The depth Cd of the secondary groove of the secondary fin 32 is ⅓ to ½ of the height HI of the fin 31. Preferably, the depth Cd of the secondary groove is between 0.3 and 0.7 mm, while the width L2 of the secondary groove is between 0.15 and 0.35 mm. A third groove 331 is defined between the top surface of the third fins 33 and two adjacent fins 31. The height H3 for a third groove 331 is between 0.15 and 0.45 mm, while the width L3 for the third fin is between 0.15 and 0.35 mm. A third fin 33 is configured as a right triangle, with the longer leg perpendicular to the fin 31. Preferably, a distance L between two corresponding edges of two axially adjacent secondary fins 32 is twice over the distance between two neighboring edges of two axially adjacent secondary fins 32. Width L2 of a secondary fin 32 equals to L/2, half of the distance L.

The preferred embodiment disclosed above is in all aspects merely illustrative. An ordinary person skilled in the art may understand that amendments and modifications can be made without departing from the scope of the invention. All these amendments and modifications shall fall within the scope of the present invention.

What is claimed is:

1. A condensing heat-exchange copper tube for a flooded type electrical refrigeration unit, comprising a smooth surface portion, a finned portion provided with a plurality of fins and a transitional portion connecting the smooth surface portion to the finned portion, each fin of said plurality of fins including a fin base close to the outer surface of the heat-exchange tube and a fin top away from the outer surface, characterized in that: each fin of said plurality of fins is further provided with a secondary fin, wherein a certain distance is provided between two axially adjacent secondary fins, and the distance between the secondary fin and the top surface of the fin is between ⅓ and ⅔ of the overall height of the fin, and wherein the secondary fin has been developed by stamping each fin radially downward from a position below each fin top; and each fin of the plurality of fins is further provided with a third fin developed by stamping each fin of the plurality of fins radially downwardly from the top surfaces of the fins, wherein a certain distance is provided between two axially adjacent third fins; and wherein a cross-section of the secondary fins define a right triangle perpendicular to each fin of the plurality of fins, a distance between an upper surface of the secondary fins and the top surface of each fin of the plurality of fins is between 0.3 and 0.7 mm, and the width of the secondary fins is between 0.15 and 0.35 mm.

2. The condensing heat-exchange copper tube for a flooded type electrical refrigeration unit according to claim 1, characterized in that: the third fins are arranged right above the secondary fins in a radial direction.

3. The condensing heat-exchange copper tube for a flooded type electrical refrigeration unit according to claim 1, characterized in that: the third fins and the secondary fins are staggeredly arranged along an axial direction.

4. The condensing heat-exchange copper tube for a flooded type electrical refrigeration unit according to claim 1, characterized in that: a cross-section of the third fins define a right triangle perpendicular to each fin of the plurality of fins, wherein a groove is defined between a top surface of the third fin and the fin top, with a depth of the groove between 0.15 and 0.45 mm, and a width of the third fins between 0.15 and 0.35 mm.

5. The condensing heat-exchange copper tube for a flooded type electrical refrigeration unit according to claim 1, characterized in that: the width of the secondary fins is equal to a distance between two neighboring edges of two axially adjacent secondary fins.

6. The condensing heat-exchange copper tube for a flooded type electrical refrigeration unit according to claim 1, characterized in that: a plurality of inner teeth are provided on an inner surface of the heat-exchange tube, wherein each tooth of the plurality of inner teeth defines a substantially triangular section.

7. The condensing heat-exchange copper tube for a flooded type electrical refrigeration unit according to claim 6, characterized in that: a height of each tooth of the plurality of inner teeth is between 0.2 and 0.4 mm, an addendum angle thereof is between 30° and 60° , and a pitch angle for each tooth of the plurality of inner teeth is between 30° and 60°.

8. The condensing heat-exchange copper tube for a flooded type electrical refrigeration unit according to claim 1, characterized in that the plurality of fins are arranged in a single spiral configuration, with an outer pitch angle between 0.3° and 1.5°.

* * * * *

US007762318C1

(12) INTER PARTES REEXAMINATION CERTIFICATE (747th)

United States Patent
Yu et al.

(10) Number: US 7,762,318 C1
(45) Certificate Issued: Nov. 22, 2013

(54) CONDENSING HEAT-EXCHANGE COPPER TUBE FOR AN FLOODED TYPE ELECTRICAL REFRIGERATION UNIT

(75) Inventors: Chuanfu Yu, Xinxiang (CN); Qiang Jiang, Xinxiang (CN); Jianjun Yan, Xinxiang (CN); Shouqing Chang, Xinxiang (CN)

(73) Assignee: Golden Dragon Precise Copper Tube Group, Inc., Xinxiang, He'Nan Province (CN)

Reexamination Request:
No. 95/002,057, Jul. 20, 2012

Reexamination Certificate for:

| | |
|---|---|
| Patent No.: | **7,762,318** |
| Issued: | **Jul. 27, 2010** |
| Appl. No.: | **11/637,622** |
| Filed: | **Dec. 12, 2006** |

(30) Foreign Application Priority Data

Dec. 13, 2005 (CN) ..... 2005 1 0134632

(51) Int. Cl.
*F28F 1/14* (2006.01)
*F28F 13/12* (2006.01)

(52) U.S. Cl.
USPC ..... 165/133; 165/184

(58) Field of Classification Search
None
See application file for complete search history.

(56) References Cited

To view the complete listing of prior art documents cited during the proceeding for Reexamination Control Number 95/002,057, please refer to the USPTO's public Patent Application Information Retrieval (PAIR) system under the Display References tab.

*Primary Examiner* — Sara Clarke

(57) ABSTRACT

The present invention discloses a condensing heat-exchange copper tube for a flooded type electrical refrigeration unit, which comprises a smooth surface portion, a finned portion provided with plurality of fins and a transitional portion connecting the smooth surface portion to the finned portion. Said fin includes a fin base close to the outer surface of the heat-exchange tube and a fin top away from the outer surface. Said fin is further provided with a secondary fin at the central portion of the fin and a third fin at the top portion of the fin, wherein a certain distance is provided between two axially adjacent secondary fins or two axially adjacent third fins. Secondary fins as well as third fins according to the invention further increase the heat transfer area for the heat-exchange tube. Meanwhile, secondary fins and third fins help to attenuate the condensate film such that the condensate film is substantially eliminated, and vapor condensation and heat transfer may be carried out in a better way. At the same time, secondary fins and third fins help to guide the condensate film away from the surface of the heat-exchange tube such that heat resistance may be reduced. Thus, the overall efficiency of heat transfer through condensation is enhanced, and the property of the condenser is improved.

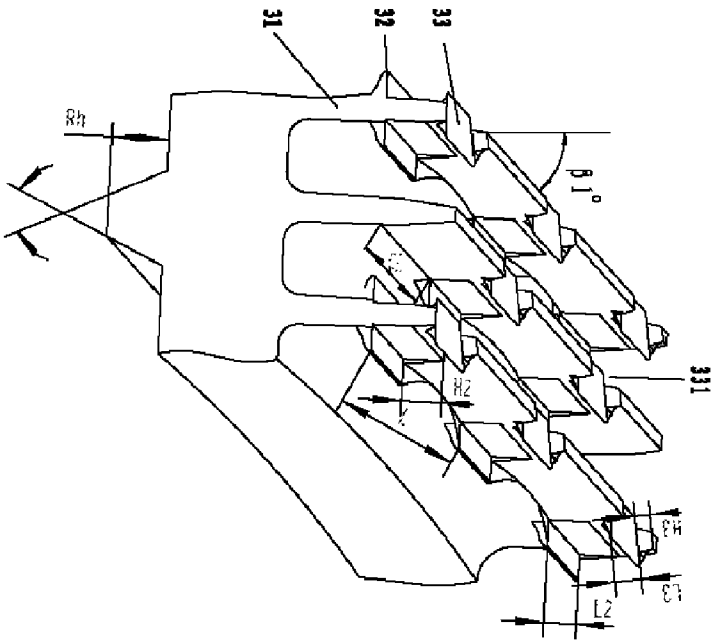

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-3 and 6-8 are cancelled.

Claims 4 and 5 were not reexamined.

* * * * *